US010081971B2

(12) United States Patent
Craig

(10) Patent No.: US 10,081,971 B2
(45) Date of Patent: Sep. 25, 2018

(54) LATCH ASSEMBLY FOR NEMA ENCLOSURES

(71) Applicant: Harrison Craig, Gulf Breeze, FL (US)

(72) Inventor: Harrison Craig, Gulf Breeze, FL (US)

(73) Assignee: Daws Manufacturing Company, Inc., Pensacola, FL (US)

( * ) Notice: Subject to any disclaimer, the term of this patent is extended or adjusted under 35 U.S.C. 154(b) by 86 days.

(21) Appl. No.: 15/435,378

(22) Filed: Feb. 17, 2017

(65) Prior Publication Data

US 2018/0238087 A1 Aug. 23, 2018

(51) Int. Cl.

| | |
|---|---|
| ***E05C 9/04*** | (2006.01) |
| ***B65D 45/16*** | (2006.01) |
| ***E05B 65/52*** | (2006.01) |

(52) U.S. Cl.

CPC ..... *E05C 9/047* (2013.01); *B65D 45/16* (2013.01); *E05B 65/5215* (2013.01)

(58) Field of Classification Search

CPC ..... E05C 9/047; E05B 65/5215; B65D 45/16
USPC .... 220/318, 324, 326, 833–835; 292/10, 19, 292/DIG. 11; 244/118.1, 118.5
See application file for complete search history.

(56) References Cited

U.S. PATENT DOCUMENTS

| | | | | | |
|---|---|---|---|---|---|
| 1,904,019 | A * | 4/1933 | Vignos | B65D 85/305 | 220/326 |
| 2,272,145 | A * | 2/1942 | Anderson | E05C 9/043 | 292/202 |
| 2,936,189 | A * | 5/1960 | Knapp | E05B 65/0014 | 206/1.5 |
| 4,194,100 | A * | 3/1980 | Cox | H01H 9/22 | 200/50.15 |
| 4,542,924 | A * | 9/1985 | Brown | E05C 19/06 | 292/87 |
| 4,923,079 | A * | 5/1990 | Foy | B65D 19/18 | 220/326 |
| 5,076,622 | A * | 12/1991 | Detweiler | E05B 47/023 | 292/125 |
| 6,615,544 | B1 * | 9/2003 | Tlemcani | E05F 1/006 | 292/337 |
| 2004/0079777 | A1 * | 4/2004 | Schomaker | B60P 3/075 | 224/404 |
| 2007/0023317 | A1 * | 2/2007 | Brozell | B65D 83/0463 | 206/538 |

* cited by examiner

*Primary Examiner* — James N Smalley
(74) *Attorney, Agent, or Firm* — GrayRobinson, P.A.; Thomas L. Kautz

(57) ABSTRACT

An enclosure is provided which meets NEMA standards of construction but with an improved latch assembly including a latch coupled to opposed latch arms which permits closure and locking of the front panel of the enclosure without the use of a key to operate the latch.

4 Claims, 6 Drawing Sheets

LATCH ASSEMBLY FOR NEMA ENCLOSURES

FIELD OF THE INVENTION

This invention relates to National Electrical Manufacturers Association (NEMA) enclosures, and, more particularly, to an improved latch assembly for such enclosures that automatically locks when the front panel is closed.

BACKGROUND OF THE INVENTION

NEMA enclosures are widely used in industrial and other applications to house hazardous parts. There are many types of NEMA enclosures, for indoor and/or outdoor use, which are categorized by numeric designation in accordance with their construction. For example, some NEMA enclosures are rated to provide mere access to hazardous parts, while others provide protection against ingress of solid foreign objects (falling dirt, circulating dust, lint, fibers etc.); ingress of water (hose down, splashing, occasional temporary submersion, occasional prolonged submersion); oil and coolant seepage, spraying and splashing; ingress of corrosive agents, and, other conditions. In order for an enclosure to receive a NEMA rating, strict construction standards promulgated by NEMA must be met.

Standards of construction for NEMA enclosures may also be employed in boxes or other containers for the storage of equipment, tools and the like in which protection against the types of conditions described above is desired. Boxes of this type, and NEMA enclosures generally, typically comprise a top panel, a bottom panel, a back panel and opposed side panels which are interconnected to form an interior. A front panel is hinged to the bottom panel and movable between open and closed positions. A seal is created between the front panel and the edges of each of the top, bottom and side panels of the enclosure which engage the front panel when closed in order to provide protection against the ingress of materials, such as discussed above, into the box interior.

Typically, NEMA enclosures and boxes which employ NEMA construction standards include a latch assembly for maintaining the front panel in a closed, locked position. Such latch assemblies generally comprise a latch coupled to opposed latch arms each movable between a retracted and extended position. In order to unlock the enclosure or box and permit opening of the front panel, a key must be inserted into the latch and turned so that the latch arms retract. The front panel is maintained in a closed, locked position by first closing the front panel, inserting the key into the latch and then turning it so that the latch arms are moved to the extended position. This presents a problem for a user who would like to close a box after having removed a tool or other equipment from it, but has his/her hands full and cannot easily close the front panel, and manipulate a key into the latch.

SUMMARY OF THE INVENTION

This invention relates to NEMA-style enclosures, and, more particularly, to an improved latch system for such enclosures that automatically locks when the front panel is closed.

This invention is predicated on the concept of providing an enclosure, which meets NEMA standards of construction but with an improved latch assembly which permits closure and locking of the front panel of the enclosure without the use of a key to operate a latch.

In the presently preferred embodiment, the enclosure comprises a top panel, a bottom panel, a back panel and opposed side panels. Each, of the side panels is formed with a front edge comprising a front wall, a back wall and an angled side wall extending between the front and back walls. A front panel is hinged to the bottom wall of the enclosure and movable between an open and closed position. The front panel mounts a latch assembly which includes a latch coupled to opposed latch arms each movable between an extended position and a retracted position. A spring element housed within the latch biases each of the latch arms to the extended position. Each latch arm mounts a tip at its free end which is preferably formed with a leading edge having a taper to engage with the angled side wall on the front edge of each of each side panel.

With the front panel open, the latch arms are biased by the spring in the latch to the extended position such that the tips of each one align with the tapered side wall on the front edge of one of the side panels. In the course of moving the front panel to a closed position, the tip of each latch arm contacts and slides along the tapered side wall of one of the side panels. The angled shape of the side walls causes the latch arms to move toward a retracted position. Once closed, the tips of each latch arm clear the angled side wall of each side panel allowing the spring in the latch to bias the latch arms to an extended position wherein each tip engages the back wall of the front edge of respective side panels. The front panel may be opened by inserting a key within the latch, and turning it, causing the latch arms to retract and clear the back wall of the front edge of the side panels.

An advantage of the improved latch assembly of this invention is that consumers may realize the benefits of using a NEMA type box but with the ability to lock the front panel in place by merely closing it rather than using a key as required in existing NEMA and NEMA-style enclosures. This allows consumers to remove articles from the interior of the enclosure and even with their hands full have the ability to close and lock, the front panel in, place, e.g. using an arm or foot to swing the front panel closed.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
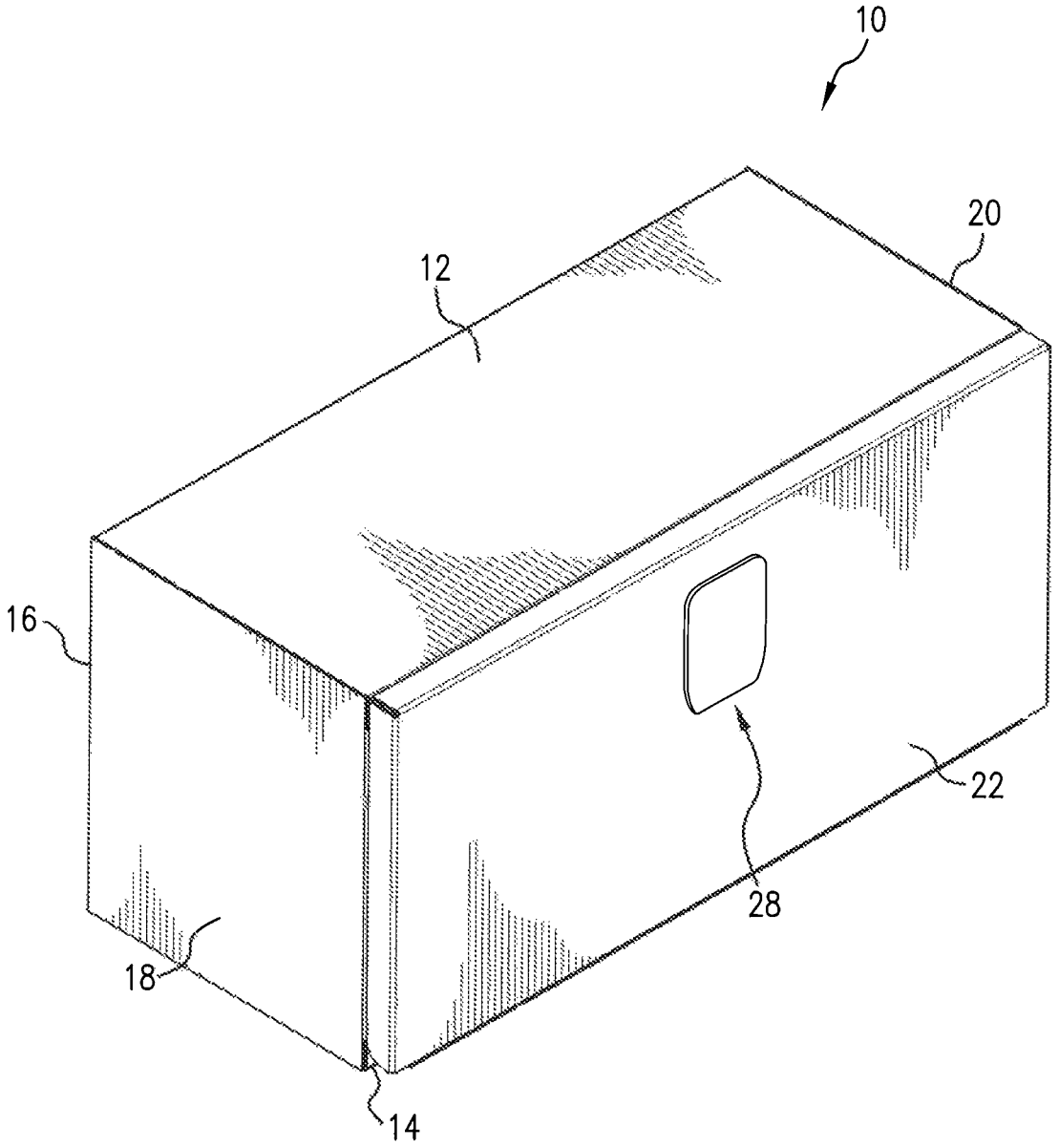
FIG. 1 is a perspective view of an enclosure with an improved latch assembly according to this invention.

Referring to the Figs., an enclosure 10 is illustrated which comprises a top panel 12, a bottom panel 14, a back panel 16, opposed side panels 18, 20 and a front panel 22 which are interconnected to form an interior 24. The front panel 22 is connected by a hinge 26 to the bottom panel 14 and movable between a closed position shown in FIG. 1 and an open position depicted in FIG. 2. For purposes of the present discussion, the terms "top," "bottom," "front," "back," "forward," "rearward," "inwardly" and "outwardly" refer to the orientation of the enclosure 10 as shown in the drawings.

Figure 2:
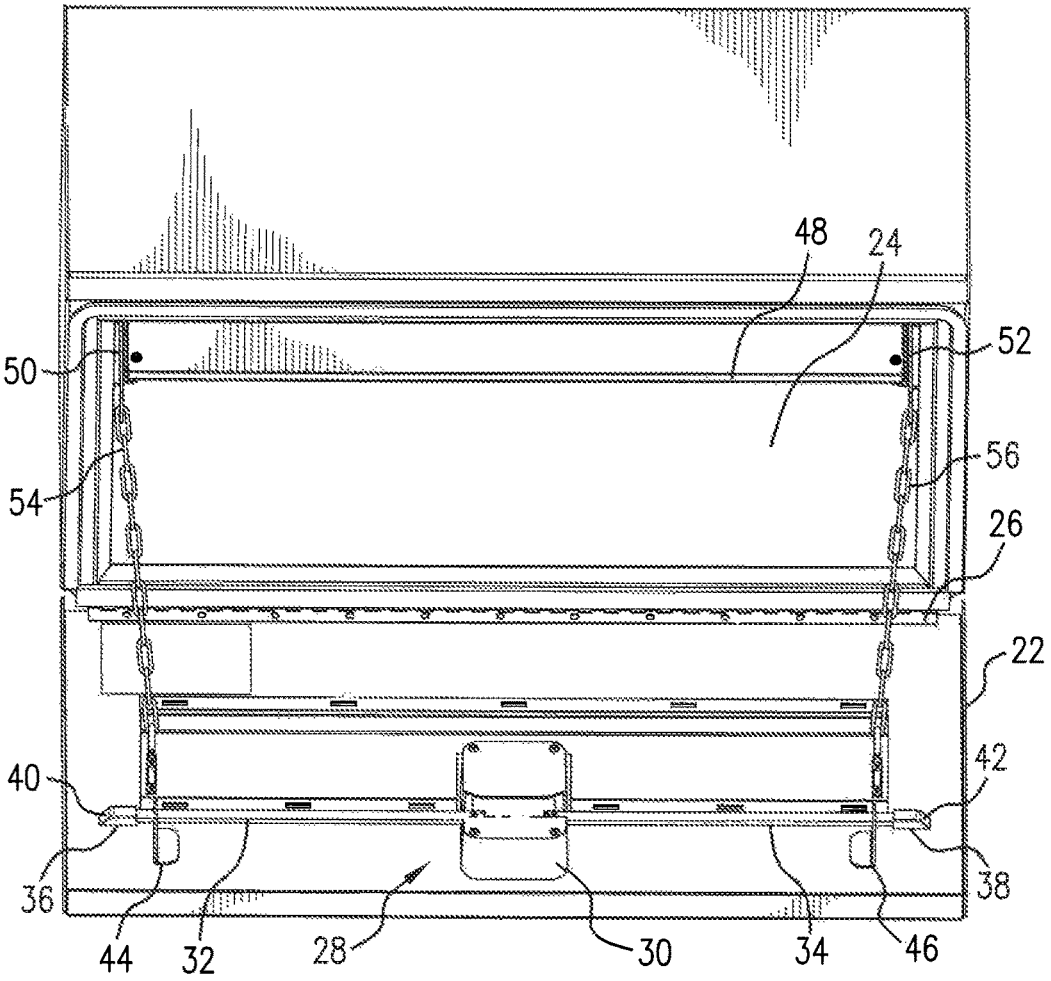
FIG. 2 is front view of the enclosure shown in FIG. 1 with the front panel in an open position.

As best seen in FIG. 2, the front panel 22 mounts a latch assembly 28 which comprises a latch 30 coupled to a latch arm 32 and a second latch arm 34. The free end of latch arm 32 mounts a tip 36, and a tip 38 is mounted to the free end of latch arm 34. Preferably, the tips 36, 38 are formed of plastic or other low friction material and each has a tapered end 40, 42, respectively. The latch assembly 28 is a commercially available item and one suitable for use in this invention is Part Number PAD-M-21DLR-50S available from Austin Hardware & Supply, Inc. of Lee's Summit, Mo.

The latch 30 is centered on the front panel 22, near the top, and latch arms 32, 34 extend outwardly toward the sides of the front panel 22. The latch arms 32, 34 are supported by guides 44, 46, respectively, which permit movement thereof between an extended position shown in FIG. 2 and a retracted position. The latch 30 includes a spring (not shown) which biases the latch arms 32, 34 away from one another toward the extended position.

Figure 6:
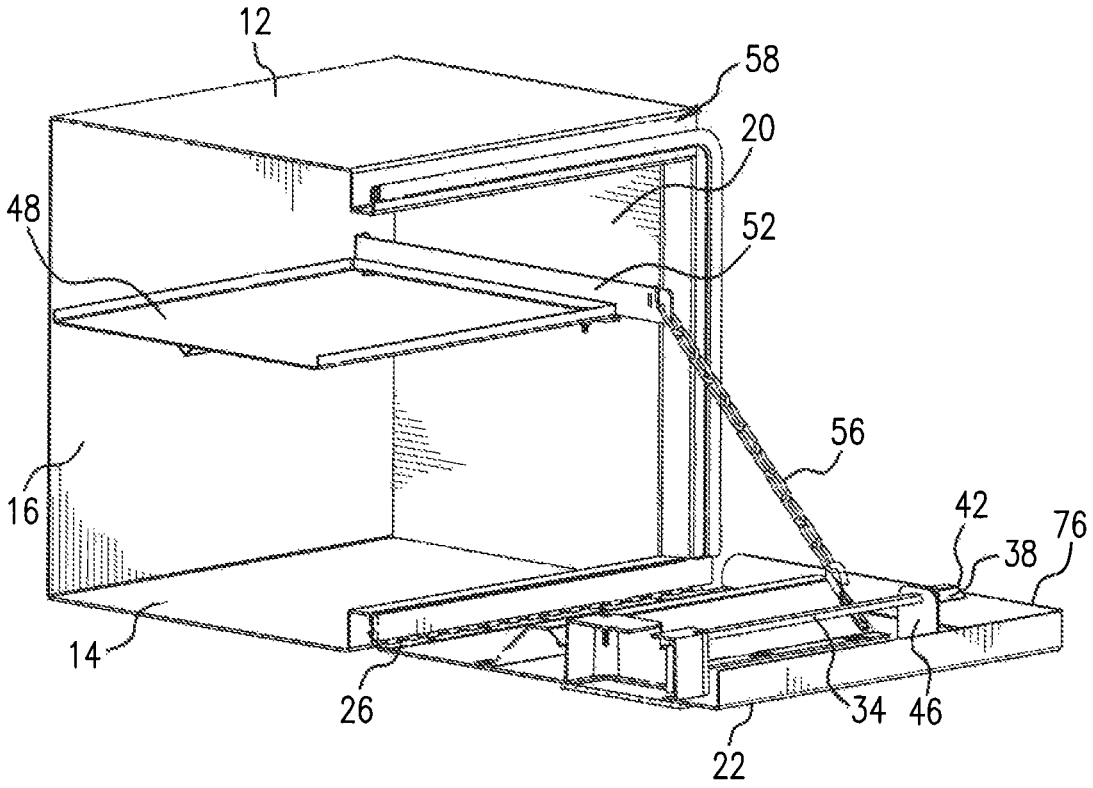
FIG. 6 is a side perspective view of part of the enclosure.

It should be understood that the size, shape and general configuration of the enclosure 10 shown in the FIG. 1 are for purposes of illustration only, and standard features NEMA enclosures may be included. For example, the enclosure 10 may include a shelf 48 mounted within the interior 24, and plates 50, 52 carried by the back panel 16 and respective side panels 18, 20 each mount a chain 54, 56 connected to the front panel 22 to hold it in an open position. See FIGS. 2 and 6. Further, a seal 58 may be provided between the top panel 12 and front panel 22 as schematically shown in FIG. 6. None of the details of these features form a part of this invention and are therefore not discussed herein.

Figure 3:
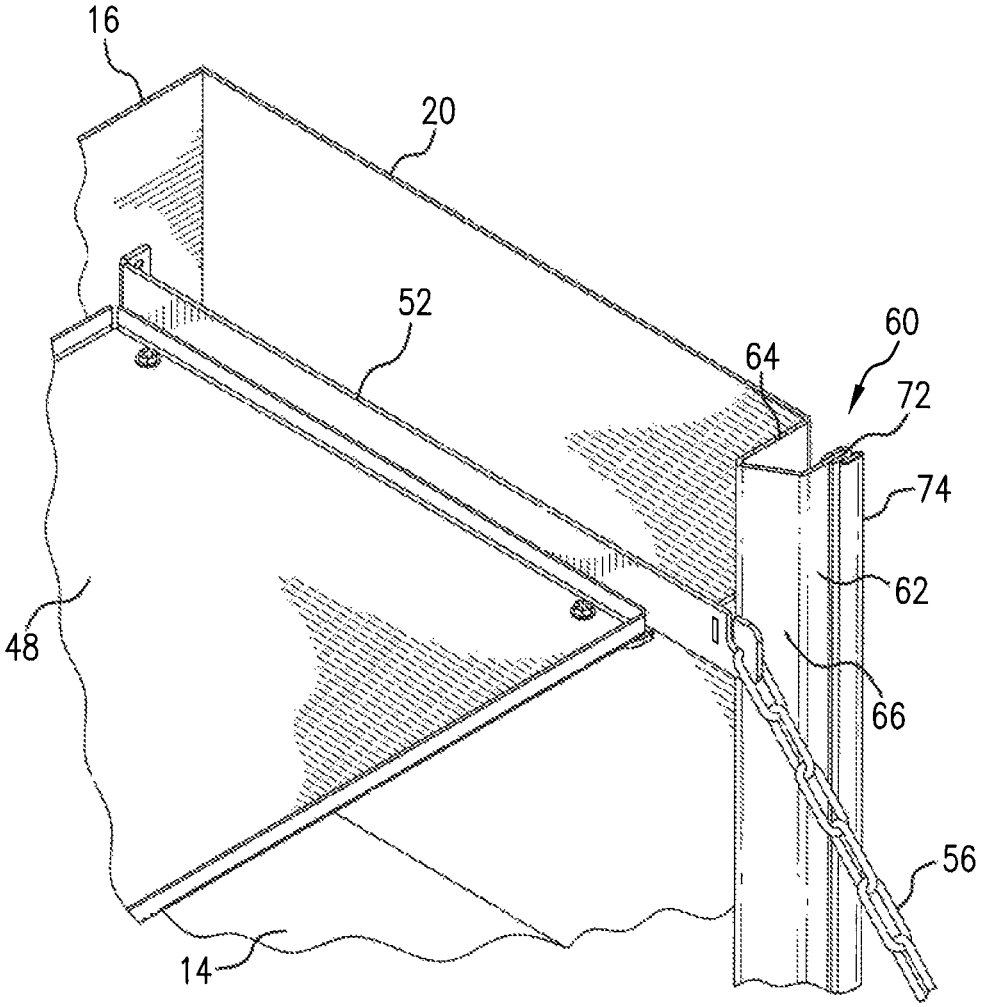
FIG. 3 is a partial perspective view of a side panel of the enclosure illustrating the front edge of one of the side panels.
Figure 4:
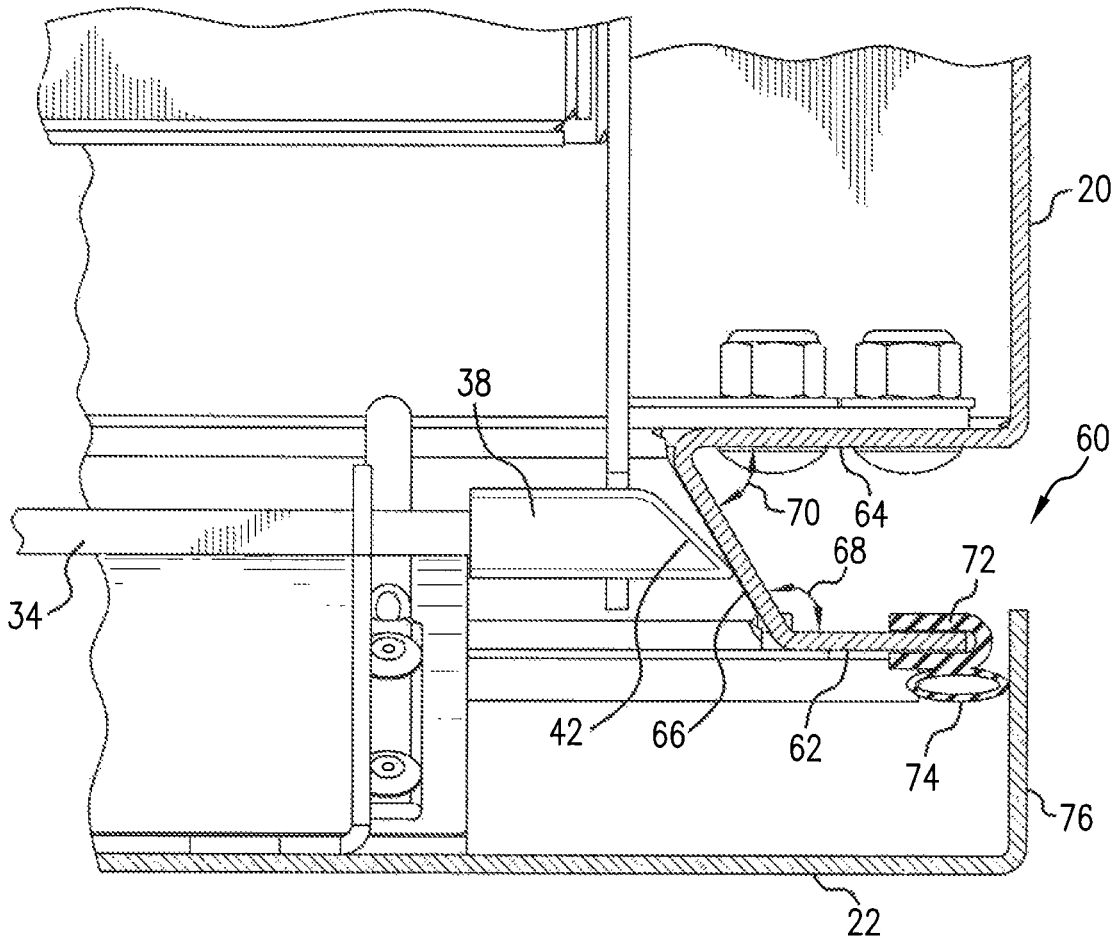
FIG. 4 is an enlarged plan view, in partial cross section, of a portion of the enclosure depicting the tip of one of the latch arms of the latch system in contact with the angled side wall of the front edge of one of the side panels of the enclosure.
Figure 5:
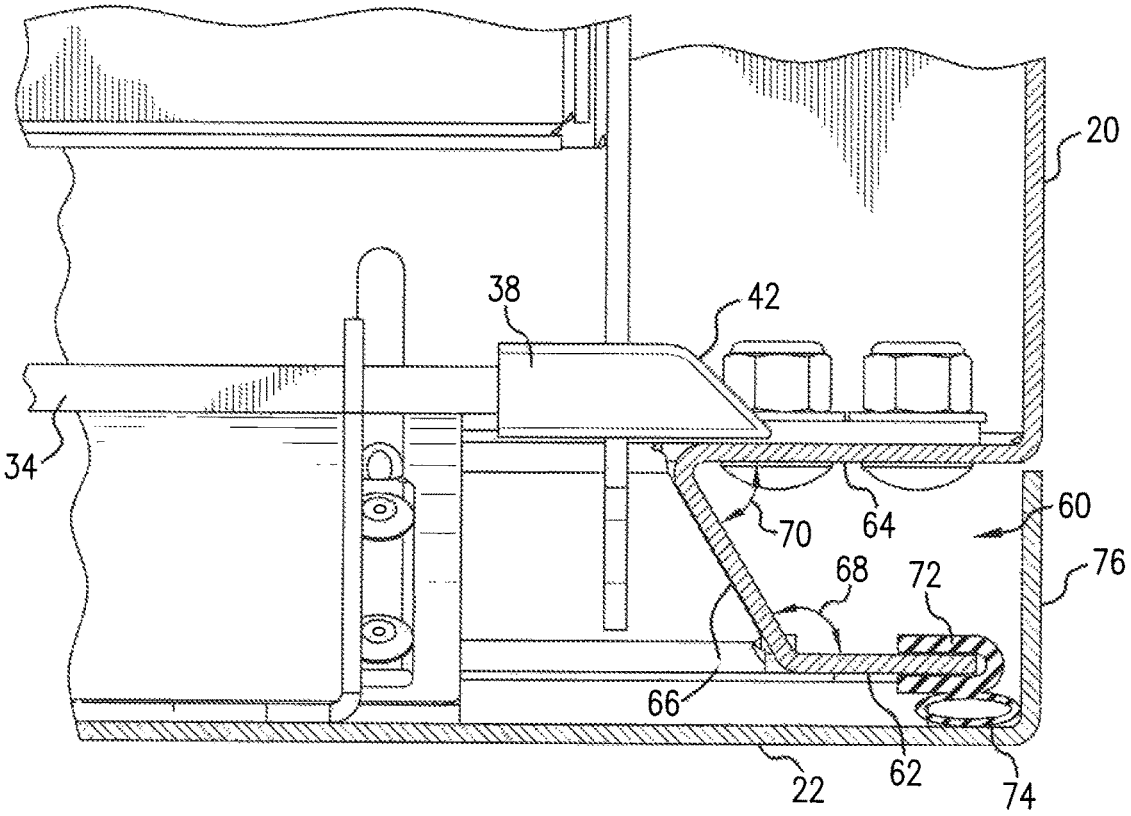
FIG. 5 is a view similar to FIG. 4 except with the latch arm extended and its tip in engagement with the back wall of the front edge of a side panel.

Referring now to FIGS. 3-5, a front edge 60 of side panel 20 is shown in more detail. The opposite side panel 18 has the same construction, and the following description applies to both side panels 18, 20. As best seen in FIGS. 4 and 5, the front edge 60 comprises a front wall 62, a back wall 64 and a side wall 66 extending between the front and back walls 62, 64. Preferably, the side wall 66 is angled such that an obtuse angle 68 is formed between the side wall 66 and front wall 62, and an acute angle 70 is formed between the side wall 66 and the back wall 64. A seal 72 extends around the front wall 62 of the front edge 60 of side panel 20 which is mounted to a secondary seal 74. Both seals 72, 74 extend along the entire height of side panel 20, e.g. from the top panel 12 to the bottom panel 14. Preferably, the front panel 22 is formed with an inwardly extending lip 76 such that the secondary seal 74 engages both the forward portion of the front panel 22, and its lip 76, when in the closed position as depicted in FIG. 5.

As noted above, the latch 30 has a spring that normally biases the latch arms 32, 34 away from one another to the extended position shown in FIG. 2. With the front panel 22 open, the latch arms 32, 34 are fully extended. In the course of closing the front panel 22, the tapered end 42 of the tip 38 of latch arm 34 contacts the angled side wall 66 of the front edge 60 of side panel 20. See FIG. 4. As the front panel 22 continues to close, the tip 38 slides along the angled side wall 66 causing the latch arm 34 to retract in a direction toward the opposite latch arm 32. Once the front panel 22 is moved to the fully closed position, the tapered end 42 of tip 38 of latch arm 34 clears the side wall 66 allowing the spring within the latch 30 to urge the latch arm 34 to its extended position. When the latch arm 34 is extended, its tip 38 engages the back wall 64 of the front edge 60 of side panel 20 thus locking the front panel 22 in the closed position. See FIG. 5. The same thing described above takes place with the opposite latch arm 32 relative to side panel 18 when the front panel 22 is closed. In order to unlock and open the front panel 22, a key (not shown) is inserted into the latch 30 and turned to move the latch arms 32, 34 toward a retracted position so that their respective tips 36, 38 disengage the back walls 64 of the front edge 60 of side panels 18 and 20.

The construction of the latch arms 32, 34, and front edge 60 of each side panel 18, 20, permits the front panel 22 to be moved to a closed and locked position without requiring one to operate the latch 30. It is possible to shut the front panel 22 with an arm or foot, which is especially helpful if one's hands are full of tools or other equipment just removed from the enclosure 10.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An enclosure, comprising:

a top panel, a bottom panel, first and second side panels and a back panel interconnected to form an interior, each of said first and second side panels having a front edge formed with a front wall, a back wall and an angled side wall extending between said front and back walls;

a front panel connected to said bottom panel and movable between an open position and a closed position relative to said interior, said front panel abutting said front wall and said front edge of each of said first and second side panels when in said closed position;

a latch assembly mounted to said front panel, said latch assembly comprising a latch coupled to a first latch arm and a second latch arm which are movable between an extended position and a retracted position, said latch being effective to bias said first and second latch arms to said extended position;

first and second tips each formed with a tapered edge, said first and second tips being mounted to an end of respective ones of said first and second latch arms in position so that said tapered edge thereof engages said angled side wall of said front edge of one of said side panels in the course of said front panel moving to said closed position causing said latch arms to slide along said angled side wall of said front edge toward said retracted position, said latch being effective to return said latch arms to said extended position after said front panel is closed so that each of said first and second tips engages said back wall of said front edge of one of said side panels to retain said front panel in said closed position.

2. The enclosure of claim 1 in which said tapered side wall of said front edge of each of said side panels is oriented at an obtuse angle relative to said front wall thereof and is oriented at an acute angle relative to said back wall thereof.

3. The enclosure of claim 1 in which a first seal is positioned about said front wall of said front edge of each of said side panels and a second seal is coupled to said first seal, said front panel being formed with a lip, said front panel and said lip of said front panel contacting said second seal when in said closed position.

4. The enclosure of claim 1 in which said first and second latch arms are supported by respective first and second guides each mounted to said front panel, said first and second latch arms being movable relative to said first and second guides between said extended and retracted positions.

* * * * *